US006178858B1

(12) United States Patent
Knerr et al.

(10) Patent No.: US 6,178,858 B1
(45) Date of Patent: Jan. 30, 2001

(54) SHAPE SAWING SYSTEM

(75) Inventors: Michael P. Knerr, Ridgefield; Mike Dockter, Woodland, both of WA (US)

(73) Assignee: U.S. Natural Resources, Inc., Vancouver, WA (US)

( * ) Notice: Under 35 U.S.C. 154(b), the term of this patent shall be extended for 0 days.

(21) Appl. No.: 08/921,779

(22) Filed: Sep. 2, 1997

(51) Int. Cl.[7] ..... B26D 5/40; B26D 5/20

(52) U.S. Cl. ..... 83/76.8; 83/368; 83/371; 83/404.1; 83/407; 83/420; 83/421; 83/425.3; 83/428; 83/445; 144/3.1; 144/39; 144/357; 144/378

(58) Field of Search ..... 83/76.8, 368, 404.1, 83/407, 420, 421, 425.3, 361, 371, 425.2, 428, 446; 144/3.1, 39, 356, 357, 378

(56) References Cited

U.S. PATENT DOCUMENTS

| | | | | |
|---|---|---|---|---|
| 261,728 | * | 7/1882 | King | 83/425.3 |
| 4,127,044 | * | 11/1978 | Kenyon | 83/446 |
| 4,144,782 | * | 3/1979 | Lindstrom | 83/420 X |
| 4,373,563 | | 2/1983 | Kenyon . | |
| 4,416,312 | | 11/1983 | Ostberg . | |
| 4,440,203 | | 4/1984 | Ostberg . | |
| 4,458,567 | | 7/1984 | Tuomaala . | |
| 4,485,861 | | 12/1984 | Nilsson . | |
| 4,548,247 | * | 10/1985 | Eklund | 83/425.3 X |
| 4,572,256 | | 2/1986 | Rautio . | |
| 4,599,929 | * | 7/1986 | Dutina | 144/39 X |
| 4,633,924 | | 1/1987 | Hasenwinkle . | |
| 4,653,560 | | 3/1987 | Wislocker . | |
| 4,690,188 | | 9/1987 | Hasenwinkle . | |
| 4,774,988 | | 10/1988 | Washburn . | |
| 4,881,584 | | 11/1989 | Wislocker . | |
| 4,893,663 | | 1/1990 | Ely . | |
| 4,907,632 | | 3/1990 | Reuter . | |
| 4,947,909 | | 8/1990 | Stroud . | |
| 5,243,888 | * | 9/1993 | Bowlin | 83/368 X |
| 5,421,386 | * | 6/1995 | Lundstrom | 144/357 |
| 5,722,474 | * | 3/1998 | Raybon et al. | 144/357 |
| 5,816,302 | * | 10/1998 | Newnes | 144/3.1 X |

FOREIGN PATENT DOCUMENTS

| | | | | |
|---|---|---|---|---|
| 549565 | * | 3/1931 | (DE) | 83/404.1 |
| 2836413 | * | 2/1980 | (DE) | 83/421 |
| 9206 | * | 11/1852 | (FR) | 83/420 |
| 33098 | | 12/1908 | (SE) . | |

* cited by examiner

*Primary Examiner*—M. Rachuba
(74) *Attorney, Agent, or Firm*—Robert L. Harrington

(57) ABSTRACT

This invention applies to a shape sawing system for sawing lumber pieces from a curved cant portion. A scanner scans the cant portion as it is conveyed on a conveyor system and inputs the scan data into a computer. The computer determines the curvature and position of the cant portion on the conveyor system. The conveyor system conveys the cant portion through side chippers and into a saw. The side chippers are independently laterally adjustable to follow the curvature of the cant portion. Guide members mounted strategic to the saw guide the cant portion into the saw. The saw is pivotally and laterally adjustable to follow the curvature of the cant portion to produce full length and partial length lumber pieces from the cant portion.

16 Claims, 6 Drawing Sheets

SHAPE SAWING SYSTEM

FIELD OF THE INVENTION

This invention relates to the cutting of logs and/or cants into lumber pieces and more particularly the cutting of logs/cants that are curved, the sawing operation following the curve of the logs/cants to maximize production.

BACKGROUND OF THE INVENTION

Historically lumber production was a matter of cutting up large diameter logs, producing as many straight boards as could be extracted from the log, with the remainder of the log (a small percentage of the total wood in the log) converted to other uses, e.g., pulp, etc. In recent times, the trees available for cutting are smaller in diameter, e.g., having a 10" diameter as compared to earlier times when the typical log diameter was measured in feet. A slight curve in a 20 foot long, 10 inch diameter log, using the old method of cutting straight lumber pieces would result in perhaps 50% of the log being wasted for lumber purposes.

Present lumber production methods have resolved this waste problem by cutting curved logs along a curved path following the curve of the log. Typically the logs are pre-processed whereby opposed sides are opened to provide opposed flat faces that facilitate control in subsequent operations. Such a pre-processed log is referred to as a cant. Hereafter the description will refer to cants or cant portions and it will be understood that such description encompasses both processed and unprocessed logs. The curved lumber pieces thus extracted from the smaller diameter cants are substantially greater in number than the straight pieces that could be extracted. However, curved sawing presents a number of challenges in the development of machinery that will efficiently produce such curved sawing.

A major problem is the proper feeding of a curved cant into and through the saws. Initially the cant conveying system was developed to feed the cant in a curved path into and through stationary saws. Because the curve changes from cant to cant, the conveyor also had to change the curve of its feeding path. More recent developments that are believed to improve on prior curved sawing techniques allows the cant to be fed along a fixed path with the cutting device, e.g., chipping heads and a bank of saw blades (a saw), being manipulated to follow the curve of the cant. The present invention is directed to this latter type of curved sawing.

In prior straight saw cutting, a cant was scanned to enable a computer to compute the optimum number of straight lumber pieces that could be cut from each cant configuration. The computer determined exactly where the cuts in the cant had to be made and the exact position of the cant on the conveyor. Thus, chipping heads (sometimes referred to as chippers or chipper heads) and saws could be set to cut the cant in accordance with a cutting pattern dictated by the computer. For curved sawing, the computer computes the optimum cutting pattern for the particular curvature of the cant and additionally dictates the curved pathway that the saws have to follow.

In a known system, the cants are conveyed on a fixed linear path. The chippers and saws are mounted on a common support for common pivotal movement but are individually mounted for lateral movement. The chipper heads are small in diameter and the saw blades of the saw are mounted immediately adjacent to and behind the chipping heads. The pivotal axis is between the chipper and saws and as the cants are fed down the fixed conveyor path, the cutting devices are manipulated by the computer and as permitted by the system to follow the curve of the cant.

There are several problems with the above system. Although close together, the commonly mounted, sequentially positioned chipping heads and saw blades are located at a different position along the curve of the cant. Thus there is no pivotal position of the common support that is ideal for both the chipping heads and the saw. The best that can be achieved is to have both the chipping heads and saws slightly offset from the desired curved cutting line. Also, with the chipping heads immediately preceding the saw, chips are thrown directly into the saw blades and disrupt the cutting action of the saw. Also the chipping heads are established at a desired width to open the side faces along the length of the cant. The cants are normally tapered and thus as the smaller end of a cant approaches the chipping heads, one of the chipping heads may be out of contact with the cant side during cutting along the narrow end. The force applied by the opposing chipping head in contact with the cant can force the cant out of its established linear path and as little as 0.030 of an inch of lateral movement of the cant can require reworking of the cant or even loss of a board. Still further, as the faces are opened by the chipping heads, the removal of this material can result in a slight but significant change to the cant's curvature and errors in the cutting process.

The preferred embodiment of the present invention addresses these and other problems with the prior systems.

BRIEF SUMMARY OF THE INVENTION

The preferred embodiment of the present invention provides chipping heads mounted for lateral movement. The saw is spaced from the chipping heads and is mounted for pivotal and lateral movement independent of the chipping heads. Finally, a set of guide members (e.g., guide rollers) are placed immediately preceding the saw and are mounted for independent lateral movement but are pivoted with the saw.

The chipping heads are typically arranged so that one chipping head is an active chipping head and the other passive. The active chipping head follows a single curved path along the entire length of the cant. The path of the passive chipping head follows the path of the active chipping head and additionally is adapted for stepping in or out to accommodate a changing diameter of the cant. In a tapered cant there is often an additional short board or two that can be retrieved from the cant in addition to the full length boards. The passive chipping head cuts the open face as desired for the full length board until the width becomes great enough to add a short board and then it steps outward to open the face for the shorter boards. (The preceding assumes the narrow end to be leading. The stepping process would be reversed if the narrow end was trailing.) This stepping arrangement provides a consistent balancing of forces by the opposed chipping heads throughout the length of cutting.

Alternatively, both chipping heads may be of the passive type and it may be desirable to step both heads outward (not necessarily at the same time) to maximize the board production. For example one head may be stepped out to provide for a sixteen foot length board at one side and subsequently the other head may be stepped out to provide an eight foot length of board on the other side.

The computer calculates the center line of the cant and its relation to the center line of the conveyor. It should be noted that the center line of the cant determined by the computer is not necessarily the geometric center line of the cant due to restrictions imposed by the machinery or the like. In any event the relative position between the center line of the conveyor and the various movable members is always known and the computer accordingly is a primary control and is able to dictate the positions of the chipping heads, guide rollers and saw relative to the cant's calculated center line. The guide rollers provide a secondary control that insure that the saws are properly positioned relative to the cant (down stream from the chipper) either (a) by forcing the cant into the curvature identified originally by the computer or (b) signaling a saw correction that is required to accommodate the slight change in the cant curvature.

The above and other advantages will be appreciated upon reference to the following detailed description having reference to the accompanying drawings.

DESCRIPTION OF THE PREFERRED EMBODIMENT

Figure 1:
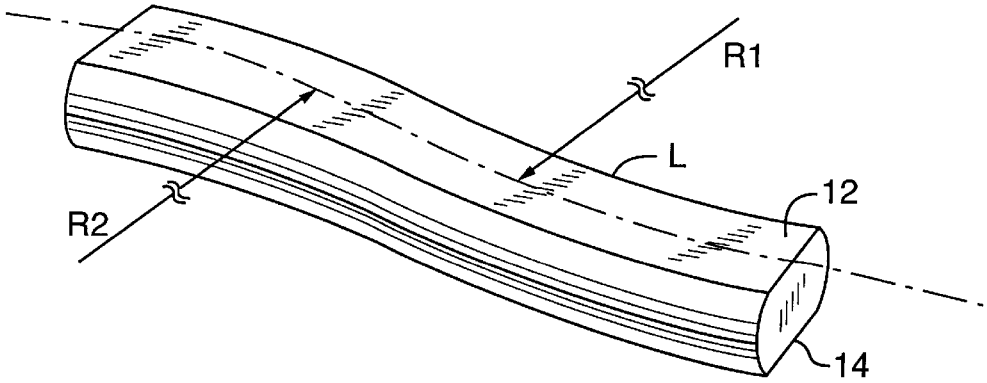
FIG. 1 is a view of a curved cant portion.
Figure 1A:
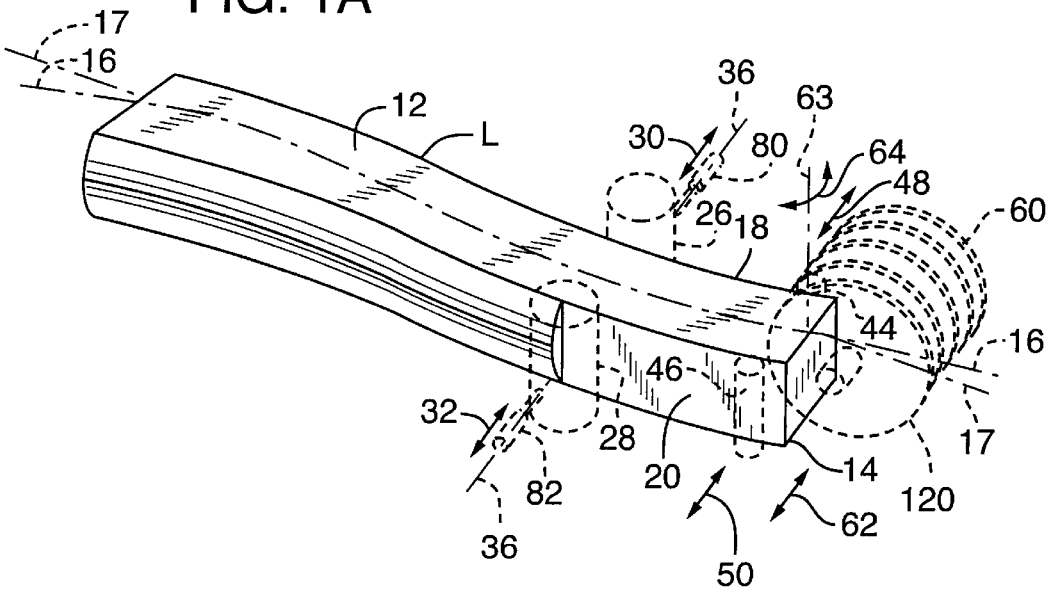
FIG. 1A is a diagrammatic view showing the cant portion of FIG. 1 in relation to chipping heads, guide members and saw.

Cants that are to be cut into lumber pieces are rarely of uniform configuration. The cants most often have a curvature that varies from one end to the other. The diameter of the cant will also vary, generally tapering from one end to the other. FIGS. 1 and 1A illustrate one example of a curved cant that has been previously chipped along two sides to produce opposed top and bottom surfaces 12 and 14. A log that has been processed to have plane surfaces along two or all four sides is often referred to as a cant. However, the process herein described may apply to other cant configurations at different stages of processing which cant configurations will collectively hereafter be referred to as cant portions L. The cant portion L in FIG. 1 illustrates one example of a curvature (a compound curvature) that has one length portion with a radius R1 and another length portion with a radius R2, both in the lateral dimension. It will be appreciated that the curvature of cant portions L will widely vary from cant to cant and no single curved cutting pattern is suitable.

The shape sawing system of the present invention is arranged to generate flat surfaces on the remaining sides of the cant portion L. The flat surfaces will have substantially the same curvature as the cant portion L. The cant portion L is then fed into a saw which follows the same curvature of the cant portion L to produce full length lumber pieces. This arrangement maximizes the lumber pieces obtainable from each cant portion L.

Referring to FIG. 1A, side chippers 26, 28 of the shape sawing system are independently adjustably movable toward and away from a center line of conveyance along an axis 36. The center line of conveyance is indicated by 17 and the direction of lateral movement of the chippers 26, 28 are indicated by directional arrows 30, 32. The chipper 26 is movable by a cylinder 80 and chipper 28 is movable by a cylinder 82.

As the cant portion L is fed (conveyed) through the chippers 26, 28, the chippers 26, 28 are laterally movable so that only a desired amount of material is removed from each side of the cant portion L. Whereas the movement of the chipping heads 26, 28 remains normal to center line 17, such movement is not normal to the curved center line 16, i.e., the computed center line for the cant. The computer computes the desired open face along each side of the cant portion and dictates the location of the chipping heads to achieve the desired face.

The cant portion L is then fed into a saw 60 spaced appropriately from the chippers 26, 28 so as to avoid chips being thrown by the chippers into the saws. A pair of guide members 44,46 are provided in close proximity to the saw 60 to aid in directing the cant portion L into the saw 60. The guide members 44, 46 are adjustably movably mounted for independent movement toward and away from the center line of conveyance as indicated by arrows 48, 50. The guide members 44, 46 are mounted to the saw assembly and pivot with the saw assembly. Accordingly, the direction of movement (arrows 48, 50) are dictated by the position of the saw assembly and vary with respect to center line 17.

The saw 60 is laterally movable relative to the center line of conveyance as indicated by arrow 62 and is pivotally mounted to be pivoted about a vertical axis 63 as indicated by arrow 64. The guide members 44, 46 are arranged to be pivoted with the saw 60. However, movement of the guide rollers cannot be normal to the center line of the cant portion and like the chippers are controlled by the computer to factor in the offset when dictating the position of the rollers, i.e., at the position of the open face of the cant (or as will be explained hereafter, where the open face is supposed to be located.)

The cant portion L is engaged by the guide members 44, 46 to guide the cant portion L into the saw 60. The guide members 44, 46 are laterally movable to engage the surfaces 18, 20 generated on the cant portion L by the chippers 26, 28. The saw 60 is pivoted and moved laterally as the cant portion is fed through the saw such that the saw cuts lumber pieces along the line of curvature of the cant portion L.

Figure 2:
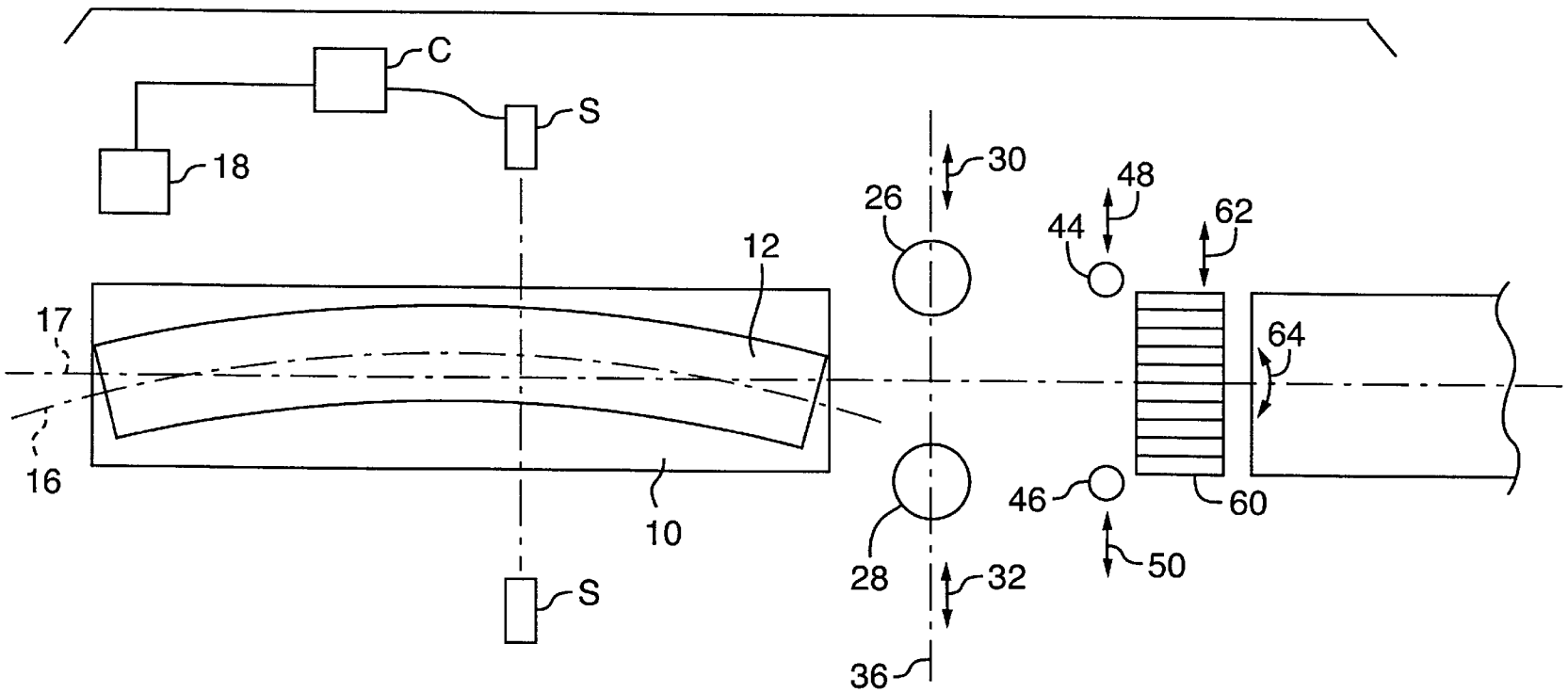
FIG. 2 is a top plan view in diagram form of a shape sawing system of the present invention.

FIG. 2 illustrates in diagram form a shape sawing system of the present invention. As previously mentioned, the shape sawing system is arranged to produce lumber pieces from a cant portion L that may have a curve or bow in it. A cant portion L which has a curvature as illustrated by example in FIG. 2 is transferred onto a known infeed conveyor 10, such as a sharp chain conveyor. The cant portion L has previously had top and bottom flat surfaces generated in a previous chipping operation with the top surface being designated as 12 and the opposed bottom surface being designated as 14

(FIG. 1). The infeed conveyor 10 conveys the cant portion L past a scanner S with the scan data from the scanner being input to a computer C. The computer C will determine the position of the cant portion L on the infeed conveyor 10, the total profile of the cant and the optimum cutting pattern for that profile including whatever saw line may be required. The cant portion L is irregular in shape and typically tapered and accordingly the radius of the curvature of the cant portion L at any one cross section may vary from one end of the cant to the other and the cross sectional width of the cant portion L will also vary from end to the other. In addition to determining the position of the cant portion L on the conveyor and its profile, the computer C will calculate the size and number of lumber pieces that desirably will be generated from the cant portion L.

In this embodiment the scanner S scans the cant portion L as it is transported on the conveyor 10. The scanner S will input the scan data to the computer C as the cant portion L is transported by the conveyor 10 into the side chippers 26 and 28.

Each of the side chippers 26, 28 are laterally movable as indicated by arrows 30, 32 by their respective cylinders 80, 82 (FIG. 1A). The side chippers 26, 28 are independently adjustable inwardly and outwardly toward the center line 17 (center line of conveyance) of the shape sawing system. The computer C will adjust the side chippers 26, 28 to engage the cant portion L as it is being transported into the chippers with the computer determining the depth of wood removal from each of the sides of the cant portion L. As seen in the figure, the center line 16 of the cant portion L is curved and, thus, the center line of the cant portion L is not superimposed on the center line 17 of the shape sawing system. The computer is able to track the center of the cant relative to the center line of the conveyor and adjust the movement of the chipper heads, guides and saws accordingly.

Figure 3:
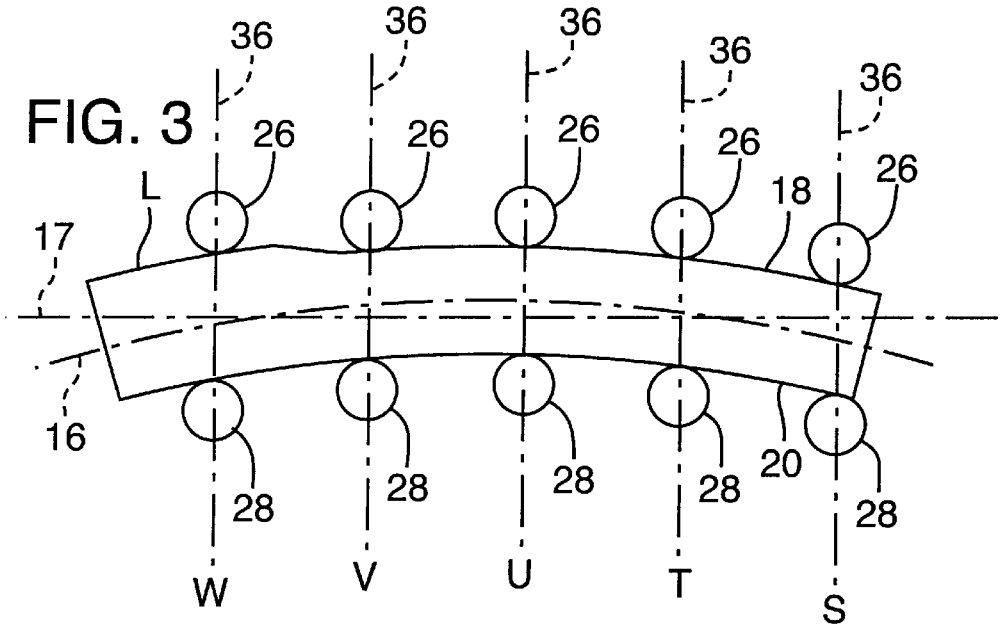
FIG. 3 is a view in diagram form showing the movement of the chippers as the cant portion is conveyed through the chippers.

FIG. 3 illustrates in diagram form how the chippers 26, 28 are adjusted relative to the cant portion L received on a conveyor system 10. The computer C will adjust the chippers 26, 28 by laterally moving the chippers 26, 28 to engage the sides of the cant portion L. As illustrated in the figure, the position of the chippers 26, 28 is illustrated in multiple positions with the multiple positions being designated as S, T, U, V and W. With reference to position S, the side chipper 26 will be moved toward the center line 17 of conveyance and the side chipper 28 will be moved laterally away from the center line 17. The chippers 26, 28 are thus adjusted relative to the cant portion L received on the conveyor 10 such that a desired portion of wood will be removed by each of the chippers 26, 28.

The cant portion L, since it has a curved configuration, requires that the chippers 26, 28 be adjusted as the cant portion L is conveyed through the side chippers 26, 28. It will be appreciated that the computer C will continuously control the lateral movement of the side chippers 26, 28 and that the positions S, T, U and V are provided for illustrative purposes. With reference to the position T, side chipper 26 will have been moved from its initial position at position S in a continuous manner to a position illustrated at position T and similarly the side chipper 28 will be moved laterally from its initial position at position S to the position illustrated at position T. As shown in the figures, the side chipper 26 will have been moved away from the center line 17 and the side chipper 28 will have been moved toward the center line 17. As the cant portion L progresses through the side chippers 26, 28, the side chippers 26, 28 will be further adjusted as illustrated by example in the positions designated as U, V and W. The side chippers 26, 28 will thus generate side surface 18, 20 (FIG. 1A) on the cant portion L as it is fed into and through the chippers 26, 28 with the side surfaces 18, 20 being substantially along the curvature of the cant portion L.

As the cant portion L progresses through the chippers 26, 28 and encounters a larger diameter (width), chipper 26 is retracted outwardly to produce an additional board from the cant portion. The larger diameter (width) is often sufficiently large to realize additional lumber pieces even though the resulting lumber pieces are not as long as the cant portion L. Referring to the example of FIG. 3, chipper 26 has been moved outwardly at position W to accommodate the increased width of the cant portion L. In this example chipper 28 is considered the active chipper, it generating a surface 20 substantially along the curve of the cant portion L. The chipper 26 in this example is considered the passive chipper, it being stepped or moved out at position W for the increased width of an additional board or lumber piece. The independent lateral movement of the chippers 26, 28 provides for equalizing of forces exerted by the chipping heads against the opposite sides of cant portion L during the chipping operation.

Whereas the cant portion length from position W to the trailing end appears short, it will be appreciated that such a step back procedure takes place when the remaining length equals the desired length of a lumber piece and may occur at any position whereat the wider cant portion is sufficient to generate an extra board.

Figure 4:
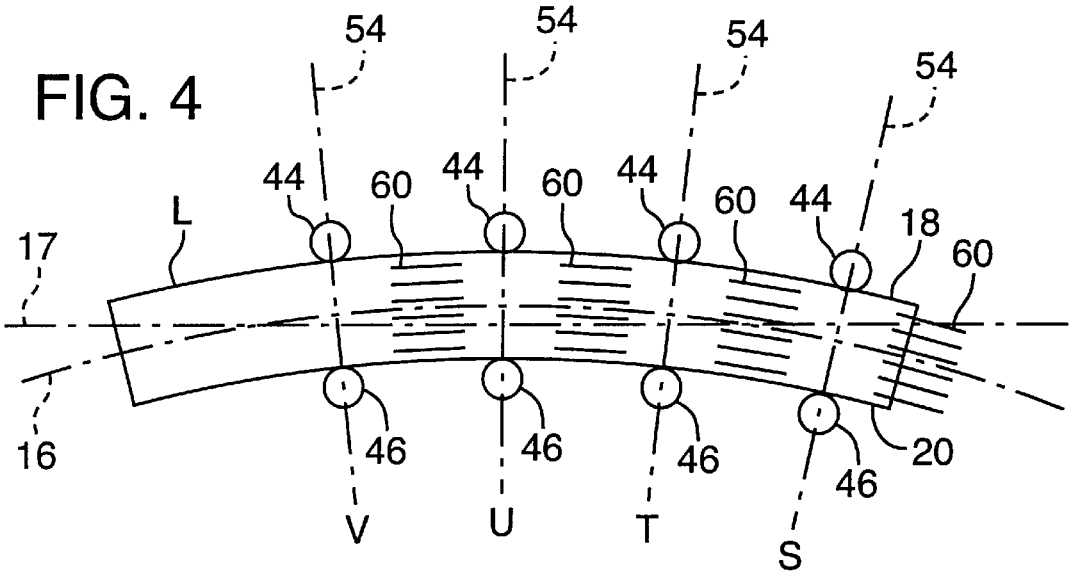
FIG. 4 is a view in diagram form showing the movement of the guide members and the saw as the cant portion is conveyed through the guide members and the saw.

Following the chipping of sides 18, 20 by chippers 26, 18, the cant portion L is thereafter directed through the guide members and into the saw 60. The guide members 44, 46, which are positioned in close proximity to the saw 60 aids in directing the cant portion L into the saw 60. FIG. 4 illustrates in diagram form examples of positions the guide members 44, 46 and the saw 60 will have in relation to the cant portion L. FIG. 4 is similar to FIG. 3 in that it illustrates multiple positions designated as S, T, U and V which show the relation of the guide members 44, 46 and the saw 60 relative to the cant portion L as it is being conveyed on the conveyor 10 along the center line of conveyance 17. Not shown in FIG. 4 is the cutting of the short board. Saw 60 includes additional saw blades that extend the width of saw 60 and such an additional saw blade will commence cutting at the positions whereat the extra board is available.

The computer C controls the lateral movement of the guide members 44, 46 and also controls the pivotal movement and the lateral movement of the saw 60. The guide members 44, 46 are also pivoted as the saw 60 is pivoted. The computer C moves the guide members 44, 46 against the sides 18, 20 of the cant portion L that have been generated by the chippers 26, 28. On occasion the curve of the cant portion L may change slightly following removal of the side material by the chippers 26, 28. The computer controls the lateral movement of the guide members 44, 46 and forces the cant portion L into its original curvature. Alternatively, the saw 60 is adjusted according to the change in curvature.

With reference to position S, the guide member 44 will have been moved against the side surface 18 that has been generated by the side chipper 26 and thus the guide member 44 will have been moved toward the center line of conveyance 17. Similarly guide member 46 is moved against the side surface 20 generated by the side chipper 28 and as illustrated in position S, the guide member 46 will have been moved laterally away from the center line of conveyance 17.

The computer also moves the saw 60 laterally and pivots the saw 60 such that the saw 60 will generate the desired lumber pieces from the cant portion L. The saw 60 is pivoted so that the individual blades of the saw 60 are substantially parallel to the center line 16 of the cant portion L. In this embodiment the vertical axis of pivot 63 (see FIG. 1A) of the saw 60 is within that portion of the saw blade that generates the arcuate kerf in the cant portion L (slightly rearward of the forward most point of the blade) and substantially at the lateral center of the saw blade assembly.

The guide members 44, 46 maintain the cant portion L in position relative to the saw 60. However, as the cant portion L is conveyed by the conveyor 10, the guide members 44, 46 will be laterally moved (relative to whatever pivotal position is dictated by saw 60) and the saw 60 will be laterally moved and pivoted to follow the curvature of the cant portion L. At position T the guide member 44 will have been moved outwardly from the center line of conveyance 17 and the guide member 46 will have been moved laterally inward toward the center line of conveyance 17. The saw 60 is moved laterally and pivotally, pivotally to maintain the near parallel attitude (i.e., the arbor 120 of the saw 60 positioned substantially normal to center line 16 of the cant portion L) and laterally as required to align the saw blades with the desired cutting lines established by the computer.

Two additional positions are illustrated as positions U and V. The saw 60 thus follows the curvature of the cant L to generate lumber pieces along the full length of the cant portion L. While only four positions have been illustrated in FIG. 4, it will be appreciated that the computer C will be continuously controlling the lateral movement of the guide members 44, 46 and the pivoting and the lateral movement of the saw 60 to produce lumber pieces from the cant portion L.

FIGS. 5–10 provide additional detail of a shape sawing system of the present invention. Whereas much of the individual mechanism is well known to the industry, only selected components are described as believed may facilitate an understanding of the invention.

Figure 5:
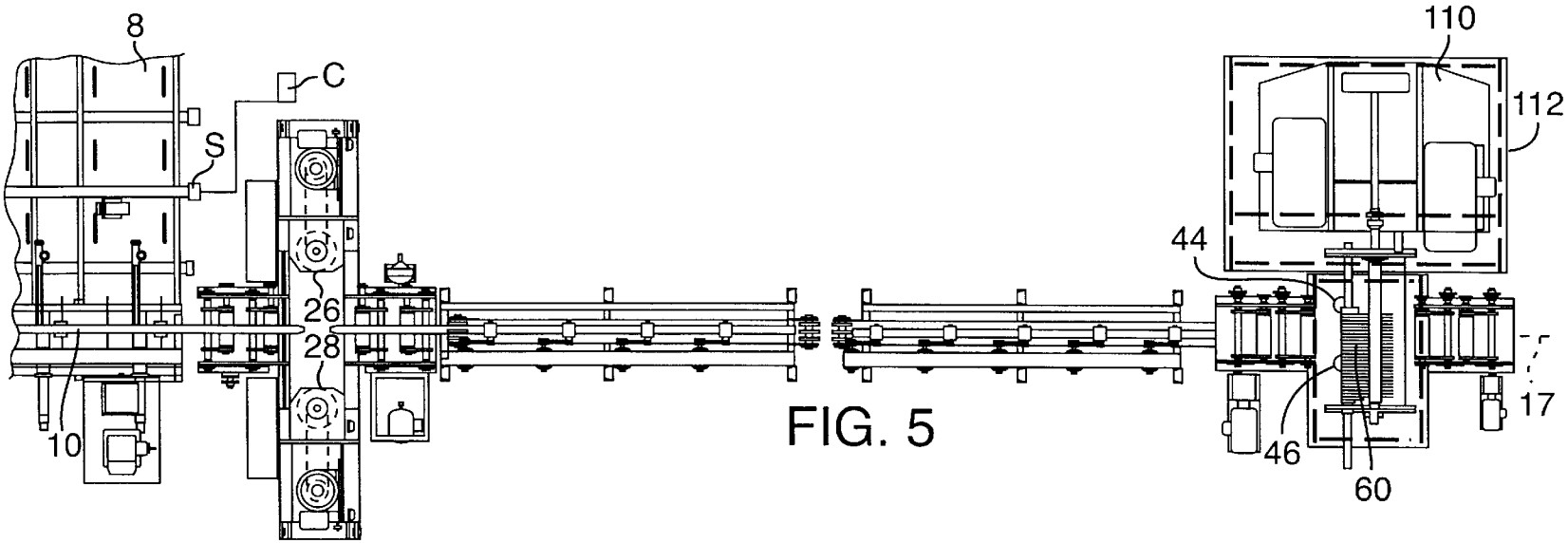
FIG. 5 is a top plan view of the shape sawing system in detail as compared to the diagram form of FIG. 2.
Figure 6:
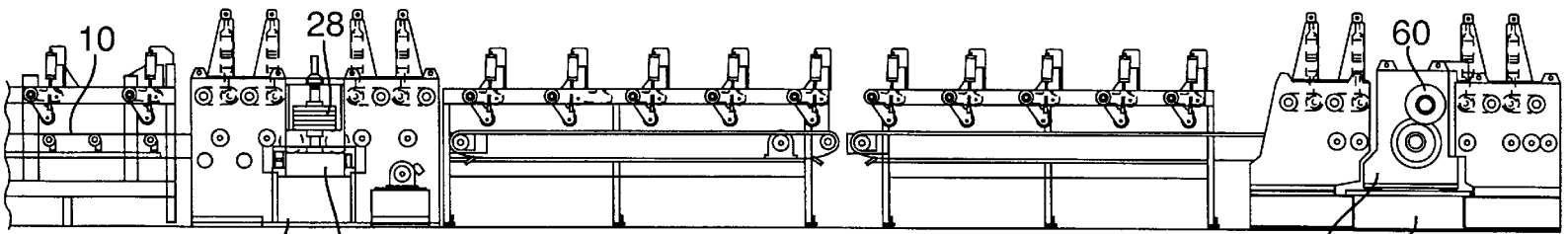
FIG. 6 is a side elevation view of the shape sawing system of FIG. 5.

Referring first to FIGS. 5 and 6, the shape sawing system conveys the cant portions laterally on conveyor 8 into alignment with the side chippers and saw to be thereafter conveyed linearly on conveyor 10 through the chippers and saw. (A single conveyor 10 is, however, an option as is illustrated in diagram form in FIG. 2.)

The scanner S of the FIG. 5 system is arranged to scan the cant portion L as it is transported on the delivery conveyor 8. The scan data from the scanner S is input to a computer C. The shape sawing system has a center line of conveyance designated as 17 which is also generally considered the center line of the shape sawing system. Side chipper 26 has a cylinder 80 (out of view in FIG. 5, see FIG. 1A) for moving the side chipper 26 toward and away from the center line of conveyance 17. Similarly side chipper 28 has a cylinder 82 (FIG. 1A) for moving the side chipper 28 toward and away from the center line of conveyance 17. The side chippers 26, 28 are mounted on a common carriage 84 (FIG. 6) with the carriage 84 being mounted on a base 86. As previously mentioned, the side chippers 26, 28 are independently movable toward and away from the center line of conveyance 17.

Figure 8:
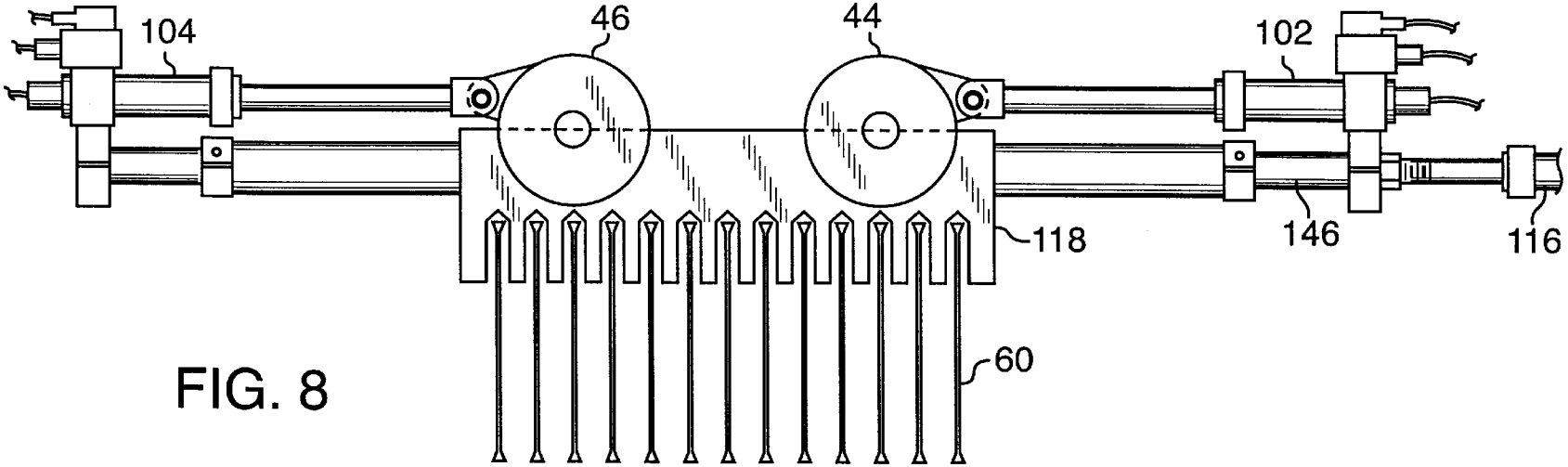
FIG. 8 is a partial view of a different set of guide members and saw also as may be used in the system of FIG. 5.
Figure 9:
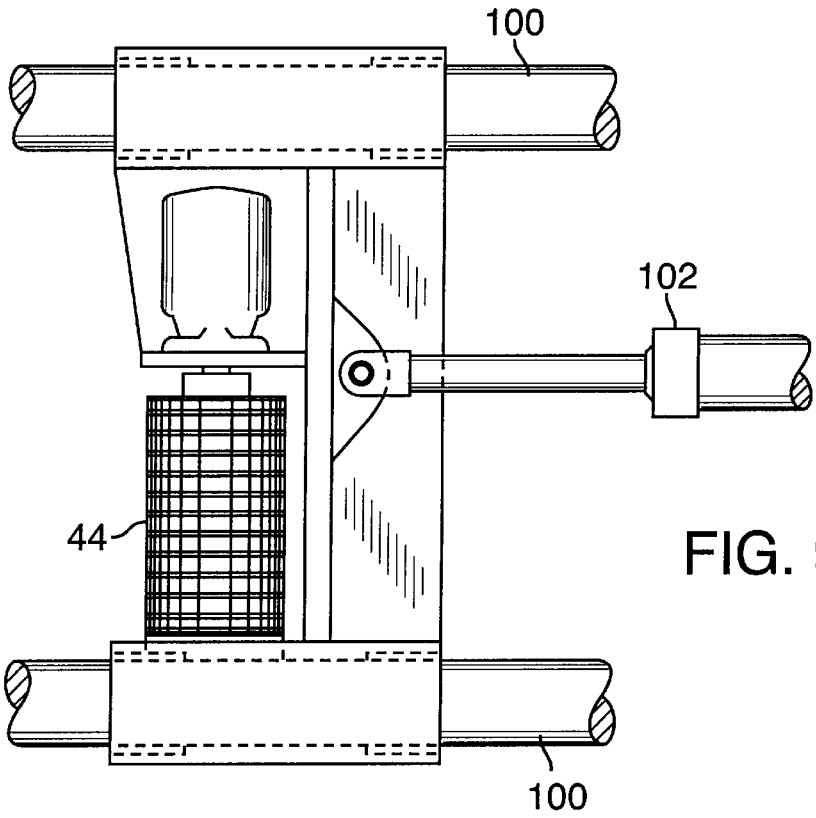
FIG. 9 is a partial side view of the guide member of FIG. 8.
Figure 10:
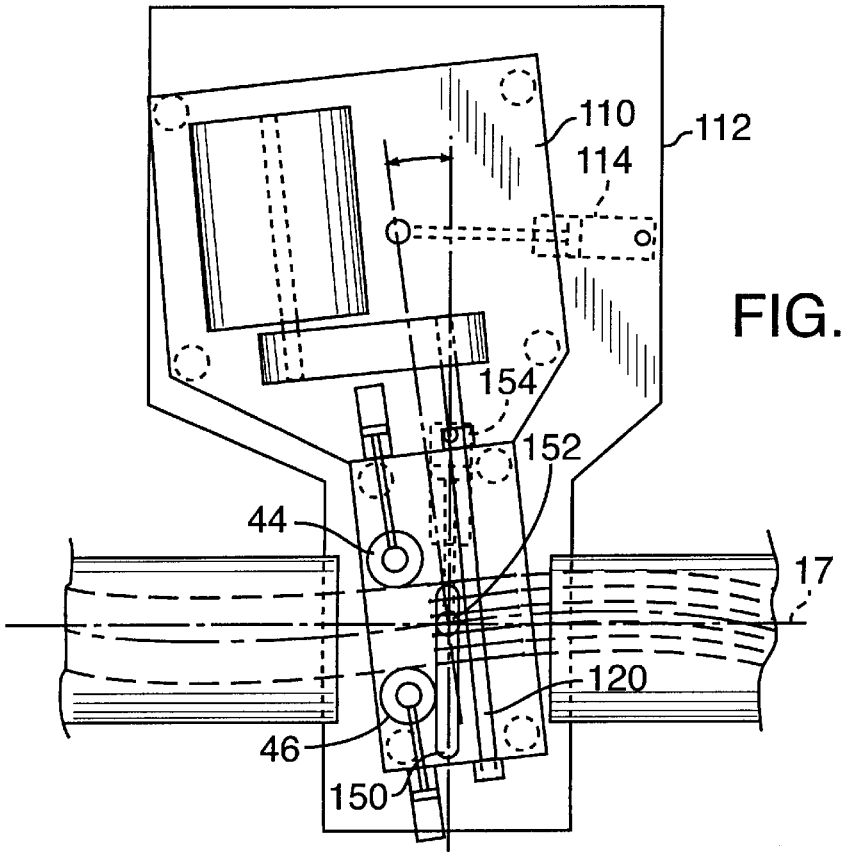
FIG. 10 is a view of a saw base assembly as used in the system of FIG. 5.

The guide members 44, 46 are mounted in close proximity to the saw 60 as best seen in FIGS. 5 and 8. In this embodiment the guide members 44, 46 are rollers that will engage the sides 18, 20 generated by the side chippers 26, 28. The guides 44, 46 are mounted on guide rails 100 (FIG. 9). The guide member 44 is movable on the guide rails 100 by a cylinder 102 and the guide member 46 is movable on the guide rails 100 by a cylinder 104. The guide rails 100 are mounted to the saw base 110 (FIGS. 5 and 10). The cylinders 102, 104 are in turn coupled to the mechanism 146 that controls movement of the saw guides (FIG. 8). The guide members 44, 46 are thus movably adjustable with the saw 60 as the cylinder 116 moves the saw guide mechanism 146. The guide members 44, 46 are, however, independently adjustable by their respective cylinders 102, 104. The guide members 44, 46 being mounted in this fashion will thus pivot with the pivoting of the saw 60 by the pivoting of the base 110 on the sub-base 112. The guide members 44, 46 are thus independently movable toward and away from the center line of conveyance 17.

The saw 60 is supported and laterally movable on the base 110. The saw 60 is adjusted laterally on the base 110 by a cylinder 116 operatively connected to saw guide 118 (FIG. 8). FIG. 5 illustrates two gangs of saws 60 mounted on the arbor 120. The cylinder 116 moves the desired gang of saws 60 into position on the arbor 120.

Referring to FIG. 10, the base 110 is movably mounted on a sub-base 112. A slot 150 is provided in the sub-base 112 with the slot 150 being normal to the center line of conveyance 17. A pivot pin 152 of the base 110 extends into the slot 150. The base 110 is pivoted on the sub-base 112 by a cylinder 114. The axis of pivot is defined by the position of the pivot pin 152. The base 110 is laterally movable on the sub-base 112 by a cylinder 154. As the base 110 is moved laterally, the pivot pin 152 will travel along the slot 150.

The saws 60 mounted on the base 110 are laterally and pivotally adjustable relative to the center line of conveyance 17. The guide members 44, 46 are pivoted and laterally adjusted with the saw 60 by the lateral and pivotal adjustment of the base 110. As previously mentioned, the guide members 44, 46 are further adjustable by cylinders 102, 104.

Figure 7:
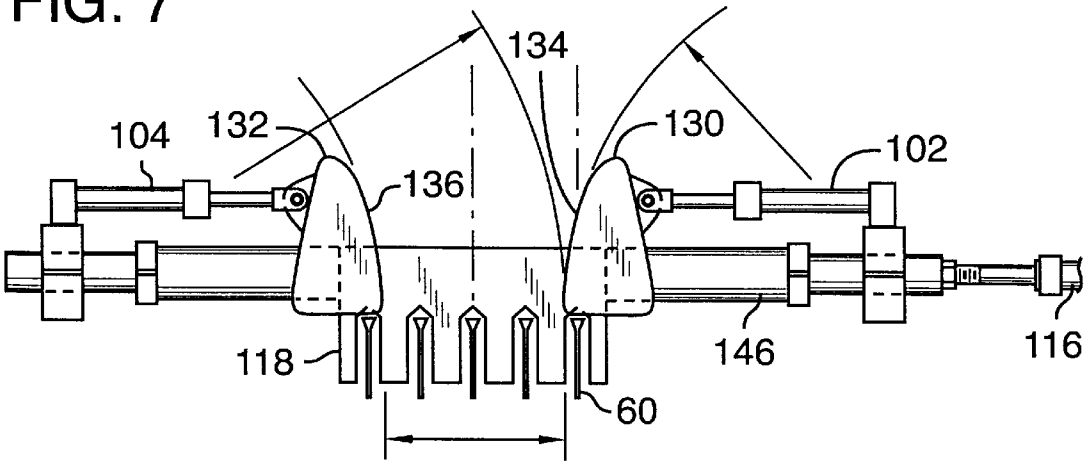
FIG. 7 is a partial view of a set of guide members as may be used in the system of FIG. 5.

FIG. 7 illustrates another arrangement of the guide members that are provided to guide the cant portion L into the saw 60. As shown in the figure, guide members 130, 132 replace roller members 44, 46 and are provided to guide the cant portion L directly into the saw 60. The guide members 130, 132 are shaped members that contact the side surfaces 18, 20 of the cant portion L. The surface 134 on guide member 130 and the surface 136 on guide member 132 have a curvature that corresponds substantially to the minimum radius contemplated in a cant portion L. The curved surfaces 134, 136 of the guide members 130, 132 will contact the sides 18, 20 of the cant portion L and direct the cant portion L into the saw 60.

Those skilled in the art will recognize that modifications and variations may be made without departing from the true spirit and scope of the invention. The invention is therefore not to be limited to the embodiments described and illustrated but is to be determined from the appended claims.

What is claimed is:

1. A shape sawing system for cutting curved cant portions into lumber pieces comprising:

a side face opening cutting device;

a saw;

guide members;

a computer;

a scanner;

a cant portion conveyor system for conveying curved cant portions on a determined path sequentially past the scanner, and linearly through the side face opening cutting device and through the saw;

said scanner determining the configuration of the cant portions and the relationship of the cant portions to the path linearly through the side face opening cutting device and saw;

said computer receiving information from the scanner and determining a pattern of curved cutting lines for the cant portions including curved exterior cutting lines at the opposed sides of the cant portions;

said side face opening cutting device mounted for lateral movement, said computer controlling lateral positioning of said side face opening cutting device for cutting away side material of the cant portions along the curved exterior cutting lines;

said guide members mounted for lateral movement and positioned between the side face opening cutting device and the saw, said computer providing a primary control for lateral positioning of said guide members to follow the curved exterior cutting lines, said saw mounted for pivotal and lateral movement independent of said side face opening cutting device, said computer providing primary control for pivotal and lateral positioning of said saw for positioning the saw relative to the curvature of the cant as determined by the computer, and a secondary control cooperatively controlling said guide members and said saw for cutting the cant portions in accordance with the pattern of cut determined by said computer in the event of a curvature change in the cant portion following removal of the side material by the side face opening cutting device.

2. A shape sawing system as defined in claim 1 wherein the secondary control is provided by the guide member forcibly urging the cant portion into the configuration as determined by the computer from the scanner information.

3. A shape sawing system as defined in claim 1 wherein the secondary control is provided by the guide members adjusting to a curvature change in the cant portion and the saw position changing in response to the adjusting of the guide members.

4. A shape sawing system as defined in claim 1 wherein the side face opening cutting device has lateral adjustment only that is normal to the linear path of the conveyor and not normal to the curved exterior cutting lines, said computer adjusting for the discrepancy and positioning the side face cutting device at the desired exterior cutting line position.

5. A shape sawing system defined in claim 1 wherein the side face opening cutting device and saw are spaced apart and independently manipulated to avoid interference of the saw operation resulting from material removed by the side face opening cutting device.

6. A shape sawing system as defined in claim 1 wherein the guide members are parallel to the saw axis and not normal to the curvature of the curved exterior cutting lines whereat side faces are opened by the side face opening cutting device, said computer adjusting for the discrepancy and positioning the guide members at the side faces.

7. A shape sawing system as defined in claim 1 wherein said side face cutting device comprises a pair of opposed side cutting chippers applying opposing forces to opposing sides of the cant portions, said scanner determining the availability of partial length lumber pieces resulting from cant taper and said computer providing step positioning of at least one of the chippers to accommodate said partial length lumber pieces and also to provide continuous engagement of the chippers with the opposing sides of the cant portions.

8. A shape sawing system for cutting curved cant portions into lumber comprising:

a conveyor conveying curved cant portions of varying curved configuration linearly along a determined path, said cant portions having computed curved cutting lines to optimize the lumber production therefrom;

a saw mounted in the determined path of a cant being conveyed, said saw having pivotal and lateral movement, a computer providing a primary control for controlling the pivotal and lateral movement of the saw in coordination with conveying movement of the cant for adjusting the saw to follow the computed curved cutting lines of the cant portions as they are conveyed through the saw;

a side face opening cutting device preceding the saw having lateral movement controlled by the computer to cut opening side faces in the cant portions in accordance with said computed curved cutting lines; and guide members following said side face opening cutting device and preceding said saw, said guide members being at least laterally movable to engage the side faces of the cant, said guide members providing a secondary control for at least one of said curved cant portions and said saw to correct any deviation occurring as the curved cant portions are conveyed into the saw.

9. A shape sawing system as defined in claim 8 wherein the guide members forcibly control the configuration of the cant portions relative to the path of conveyance as the cant portions enter the saw.

10. A shape sawing system as defined in claim 8 wherein the guide members adjust in response to a changed configuration of the cant portions resulting from the side faces being opened by the side face opening cutting device and said saw responding to adjustment of the guide members and adjusting to the changed configuration.

11. A sawing system for cutting tapered cant portions into lumber pieces, said tapered cant portions having a greater cross section at one end from which an additional shorter length lumber piece may be produced, said sawing system comprising:

a conveyor conveying tapered cant portions along a path, a saw positioned in the path to cut the tapered cant into lumber pieces, and a pair of chippers, one on each side of the cant and producing an opening side cut along the entire length at each side of the cant;

a computer determining the line of cut to be made by the chippers including a step cut for the provision of an additional shorter length lumber piece to be cut from the cant;

at least one of the chippers having independent lateral movement for lateral stepping of the chipper to accommodate a width difference at the position whereat the additional shorter length lumber piece is to be cut, whereby the chippers are maintained in engagement with the cant throughout the opening side cut at each side of the cant.

12. A sawing system as defined in claim 11 wherein the shape sawing system cuts tapered cant portions that are curved with the cant portions conveyed through the saw and chippers linearly and wherein the computer computes the sawing of curved lumber pieces from said cant portions, said chippers having cooperative continuous lateral adjustment so as to follow a curvature at each side dictated by the computer and including a further stepped lateral adjustment of at least one of the chippers for the additional shorter length lumber piece.

13. A sawing system as defined in claim 12 wherein both chippers are laterally adjusted for stepped lateral adjustment to accommodate an additional shorter length lumber piece at each side of the cant portion.

14. A shape sawing system for cutting curved cant portions into lumber comprising:

a conveyor for conveying curved cant portions of varying curved configuration linearly along a determined path, said cant portions having computed curved cutting lines to optimize the lumber production therefrom;

a saw mounted in the determined path of a cant being conveyed and having pivotal and lateral movement, a computer controlling the pivotal and lateral movement of the saw in coordination with conveying of the cant for adjusting the saw to follow the computed curved cutting lines of the cant portions as they are conveyed through the saw; and said pivotal movement for the saw having a vertical axis of pivot provided rearward of the forward most point of the blade and substantially at the lateral center of the saw blade assembly.

15. A shape sawing system for cutting curved cant portions into lumber comprising:

a conveyor for conveying curved cant portions of varying curved configuration linearly along a determined path, said cant portions having computed curved cutting lines to optimize the lumber production therefrom;

a saw mounted in the determined path of a cant being conveyed and having pivotal and lateral movement, a computer controlling the pivotal and lateral movement of the saw in coordination with conveying of the cant for adjusting the saw to follow the computed curved cutting lines of the cant portions as they are conveyed through the saw; and said pivotal movement for the saw having a vertical axis of pivot that is laterally adjustable for maintaining the pivot at a desired position relative to the saw blade assembly.

16. A shape sawing system as defined in claim 15 wherein the saw is mounted on a base which is mounted on a sub-base, a pin from the base projected through a lateral slot in the sub-base, and movers moving the base laterally and pivotally relative to the sub-base as permitted by the slot.

* * * * *